US006797752B1

(12) United States Patent
Rohringer

(10) Patent No.: US 6,797,752 B1
(45) Date of Patent: Sep. 28, 2004

(54) USE OF WHITENING PIGMENTS FOR WHITENING PAPER COATING COMPOSITIONS

(75) Inventor: Peter Rohringer, Schönenbuch (CH)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 174 days.

(21) Appl. No.: 10/048,758

(22) PCT Filed: Jul. 27, 2000

(86) PCT No.: PCT/EP00/07245

§ 371 (c)(1),
(2), (4) Date: Feb. 1, 2002

(87) PCT Pub. No.: WO01/11140

PCT Pub. Date: Feb. 15, 2001

(30) Foreign Application Priority Data

Aug. 5, 1999 (EP) ..... 99810698

(51) Int. Cl.[7] ..... C08K 5/34
(52) U.S. Cl. ..... 524/100; 524/593; 524/594
(58) Field of Search ..... 524/100, 593, 524/594, 570

(56) References Cited

U.S. PATENT DOCUMENTS 4,405,751 A 9/1983 Mueller et al. ..... 524/720

FOREIGN PATENT DOCUMENTS

| | | |
|---|---|---|
| DE | 4401471 | 7/1994 |
| DE | 19500195 | 7/1996 |
| FR | 1221145 | 5/1960 |
| GB | 2284829 | 6/1995 |

*Primary Examiner*—Bernard Lipman
(74) *Attorney, Agent, or Firm*—Kevin T. Mansfield

(57) ABSTRACT

The use of whitening pigments comprising (a) a melamine-formaldehyde or phenol-formaldehyde polycondensation product and (b) a water-soluble fluorescent whitening agent of formula (1), wherein $R_1$ and $R_2$ are each independently of the other —OH, —Cl, —$NH_2$, —O—$C_1$–$C_4$alkyl, —O—aryl, —NH—$C_1$–$C_4$alkyl, —N($C_1$–$C_4$alkyl)$_2$, —N($C_1$–$C_4$alkyl)($C_1$–$C_4$hydroxyalkyl), —N($C_1$–$C_4$hydroxyalkyl)$_2$, or —NH—aryl, for example aniline-mono- or -di-sulfonic acid or an anilinesulfonamide, morpholino, S—$C_1$–$C_4$alkyl(aryl), or a radical of an amino acid, for example aspartic acid or inimoacetic acid, which radical is substited at the amino group, and M is hydrogen; sodium; potassium; calcium; magnesium; ammonium; mono-, di-, tri- or tetra-$C_1$–$C_4$alkylammoniun; mono-, di- or tri-$C_1$–$C_4$hydroxyalkylammonium; or ammonium di- or tri-substitue by a mixture of $C_1$–$C_4$ alkyl and $C_1$–$C_4$hydroxyalkyl groups, for whitening paper coating compositions.

10 Claims, No Drawings

USE OF WHITENING PIGMENTS FOR WHITENING PAPER COATING COMPOSITIONS

This is a 371 of international application No. PCT/EP 00/07245, filed on Jul. 27, 2000.

The present invention relates to the use of whitening pigments for whitening paper coating compositions.

Aqueous coating compositions are used extensively in the production of coated papers and cardboards. For the purpose of whitening, the coating compositions generally comprise anionic fluorescent whitening agents, the action of which is highly dependent on the amount and nature of co-binders used. The use of cationic coating compositions, for example for ink-jet papers, results in a loss of effect, for example poor fastness to light, bleeding in food packaging and a deterioration in printability. Similar problems can also occur in the case of pulp or size press applications.

It has now been found, surprisingly, that certain whitening pigments that comprise melamine-formaldehyde resin and a water-soluble fluorescent whitening agent significantly improve the properties of the coating compositions.

The present invention accordingly relates to the use of whitening pigments comprising (a) a melamine-formaldehyde or phenol-formaldehyde polycondensation product and (b) a water-soluble fluorescent whitening agent, for whitening paper coating compositions.

Condensation products of melamine and formaldehyde, also referred to as melamine-formaldehyde (MF) resins, are aminoplastic resins.

The said condensation products are prepared by acid- or base-catalysed reaction of melamine in a methylolation reaction with aqueous formaldehyde solutions to form N-methylol compounds. On extending the reaction time or increasing the temperature, the methylol groups then react with further melamine, forming methylene bridges or—when metnylol groups react with one another—methylol ether bridges.

The reaction is usually halted at the stage where preliminary condensation products, which are still soluble or meltable, are present, in order for fillers to be added i desired. To improve the solubility of those preliminary condensation products, some of the methylol groups still remaining may, in addition, be etherified.

The substance from that initial stage may also be formulated as an aqueous solution in which the fluorescent whitening agent can then be incorporated.

Etheritication of the N-methylol compounds may also be carried out, after azeotropically distilling off the water with alcohols or by spray-drying, by etherifying the practically water-free methylol-melamines with lower alcohols, with the addition of acid or alkaline catalysts, neutralising after etherification and, where appropriate, distilling off the excess alcohol.

In a further embodiment, polycondensation of the formaldehyde with the aminoplast-former melamine or phenol is carried out in the presence of the fluorescent whitening agent.

Fluorescent whitening agents corresponding to component (b) that are suitable for use according to the invention correspond to formula

1)

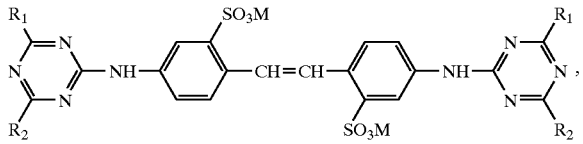

wherein $R_1$ and $R_2$ are each independently of the other —OH, —Cl, —$NH_2$, —O—$C_1$—$C_4$alkyl, —O-aryl, —NH—$C_1$—$C_4$alkyl, —N($C_1$—$C_4$alkyl)$_2$, —N($C_1$—$C_4$alkyl)($C_1$—$C_4$hydroxyalkyl), —N($C_1$—$C_4$hydroxyalkyl)$_2$ or —NH—aryl, for example anilino, aniline-mono- or -di-sulfonic acid or an anilinesulfon-amide, morpholino, —S—$C_0$—$C_4$alkyl(aryl), or a radical of an amino acid, for example aspartic acid or iminoacetic acid, which radical is substituted at the amino group, and M is hydrogen; sodium; potassium; calcium; magnesium; ammonium; mono-, di-, tri- or tetra-$C_1$—C4alkylammonium; mono-, di- or tri-$C_1$—C4hydroxyalkylammonium; or ammonium di- or tri-substituted by a mixture of $C_1$—$C_4$alkyl and $C_1$—$C_4$hydroxyalkyl groups Especially suitable fluorescent whitening agents of formula (1) are those wherein the group $R_1$ is an anilino radical, more especially those wherein the group $R_2$ is NH—$C_1$—$C_4$alkyl, —N($C_1$—C4alkyl)2, —N($C_1$—$C_4$alkyl) ($C_1$—$C_4$hydroxyalkyl), —N($C_1$—$C_4$hydroxyalkyl)$_2$, morpholino, or a radical of an amino acid, for example aspartic acid or iminoacetic acid, which radical is substituted at the amino group, and M is hydrogen; sodium or potassium.

$C_1$—$C_4$alkyl radicals are branched or unbranched and are, for example, methyl, ethyl, propyl, isopropyl or n-butyl; they may be unsubstituted or substituted by halogen, for example fluorine, chlorine or bromine, $C_1$—$C_4$alkoxy, for example methoxy or ethoxy, phenyl or carboxyl, $C_1$—$C_4$alkoxycarbonyl, for example acetyl, mono- or di-($C_1$—$C_4$alkyl)amino or by —$SO_3$M.

The compounds of formula (1) are used preferably in neutral form, that is to say: M is preferably a cation of an alkali metal, especially sodium.

The fluorescent whitening agents corresponding to component (b) are present in the whitening pigment for use according to the invention in an amount of from 0.05 to 10% by weight, preferably from 0.1 to 5% by weight.

The whitening pigments used in accordance with the invention may also comprise, in addition to the melamine-formaldehyde or phenol-formaldehyde resin, further copolymers (component (c)) with, for example, aromatic sulfonamides, cyanuric acids, urea, cyclised ureas, for example ethylene urea, or glyoxalic acid.

Preferably, the whitening pigments used in accordance with the invention additionally comprise a copolymer with an aromatic sulfonamide.

Preferably, a melamine-formaldehyde polycondensaton product is used as component (a).

The whitening pigments for use according to the invention are prepared in various ways.

In one process variant, they can be prepared in a melting process, the procedure for which is as follows:

The aromatic sulfonamide is melted in a suitable reaction vessel. The formaldehyde is then added slowly to the molten sulfonamide. A low-melting resin forms. When that reaction is complete, this resin is allowed to react further with the melamine. Cocondensation occurs, a resin having a relatively high melting point of from 115 to 135° C. being formed. At the end of the reaction the fluorescent whitening agent is added to the reaction mixture. The resinous reaction mixture is dispensed in droplets at a temperature of from 150 to 175° C. into a suitable storage container and is left to cool.

The glassy resin material is then comminuted, using a suitable appliance, into pieces about 3 mm in size. The resulting material is then introduced into a suitable grinding apparatus, for example a ball, hammer or vibration mill, in which the resin is ground to a size of from 5 to 6 $\mu$m.

In a further variant, the whitening pigments can be prepared in a water-based process, the procedure for which is as follows:

The whitening pigment used in accordance with the invention can be prepared by mixing components (a) and (b), preferably in the presence of a solvent especially water. Component (a) is preferably used in the form of a preliminary condensation product or a low-molecular-weight N-methylol derivative. After mixing, the solvent can optionally be removed.

The pigments are then dried, ground and optionally re-dispersed in aqueous media for further use.

The whitening pigments used in accordance with the invention preferably comprise (a) from 75 to 99% by weight, preferably from 85 to 95% by weight, of a melamine-formaldehyde or phenol-formaldehyde polycondensation product, (b) from 0.05 to 5% by weight, preferably from 0.1 to 5% by weight, of a water-soluble fluorescent whitening agent, and (c) from 0 to 20% by weight, preferably from 5 to 10% by weight, of an aromatic sulfonamide.

The finely particulate whitened whitening pigments can, after dry-grinding, be incorporated in powder form directly in the paper coating composition, the particle size being from 0.05 to 40 $\mu$m, preferably from 0.3 to 10$\mu$m and especially from 0.5 to 5 $\mu$m.

In most instances, however, it will probably be more convenient to disperse the finely particulate whitening pigments in an aqueous phase and to incorporate the resulting aqueous dispersion in the paper coating compositions.

The amount of whitening pigments for use according to the invention employed in the paper coating composition depends on the desired whitening effect it is usually from 0.01 to 5% by weight of pure active substance, based on the melamineformaldehyde or phenol-formaldehyde polycondensation product used.

The paper coating compositions generally have a solids content of from 35 to 80% by weight, preferably from 40 to 70% by weight. In addition to the whitening pigment for use according to the invention, they generally comprise (all amounts based on the pigment)

(i) 100 parts by weight of inorganic pigment, (ii) from 3 to 25 parts by weight of binder, of which optionally up to halt consists of natural (i.e. non-synthetic) co-binder (for example starch, casein), (ii) up to 1 part by weight of thickener and (iv) up to 2 parts by weight of wet-strength agent.

The whitening pigments according to the invention are excellently suitable for whitening the optionally pigmented coating compositions customarily used in the textile, paint, adhesives, plastics, wood and paper industries. Such coating compositions comprise, as binders (co-binders), plastics dispersions based on copolymers of butadiene and styrene, of acrylonitrile, butadiene and styrene, of acrylic acid esters, of ethylene and vinyl chloride and of ethylene and vinyl acetate, or homopolymers, such as polyvinyl chloride, polyvinylidene chloride, polyethylene, polyvinyl acetate or polyurethane.

For the purpose of pigmenting the coating compositions there are generally employed aluminium silicates, such as China clay or kaolin, and also barium sulfate, satin white, titanium dioxide or calcium compounds for paper. These are described by way of example in J. P. Casey "Pulp and Paper; Chemistry and Chemical Technology", 2nd Ed. Vol. 111; p. 1648–1649 and in Mc Graw-Hill "Pulp and Paper Manufacture", 2$^{nd}$ Ed. Vol. II, p. 497 and in EP-AQ 003 568.

The whitening pigments according to the invention may be used especially for the coating of paper, more especially ink-jet and photographic paper, wood, foils, textiles, non-woven materials and suitable building materials. Special preference is given to use on paper and cardboard and on photographic papers.

The coatings or coverings so obtained have, in addition to a high degree of fastness to light, an excellent degree of whiteness. Evenness, smoothness, volume and printability properties are also improved because the whitening pigments used in accordance with the invention remain in the paper matrix as additional filler and have a favourable effect on the printability of the paper.

The following Examples illustrate the invention.

EXAMPLE 1

Preparation of the Whitening Pigment 1.5 g of active substance, fluorescent whitening agents of formula (2)

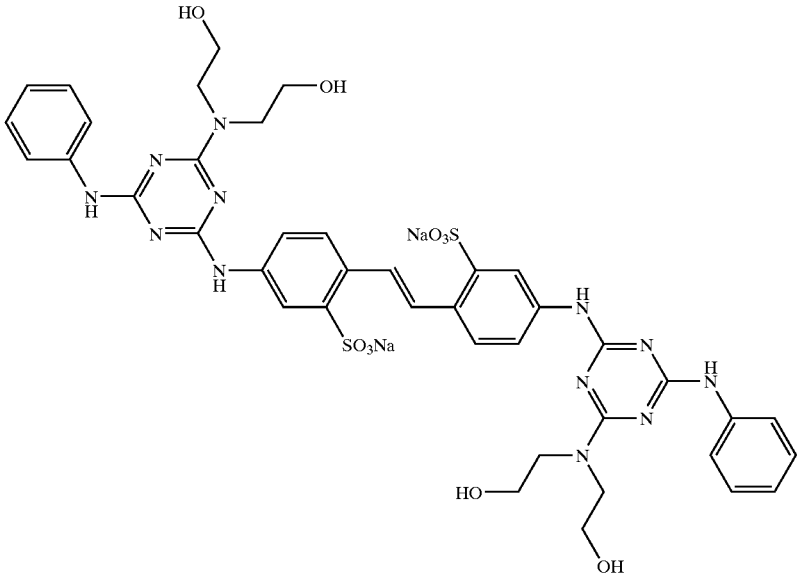

or

-continued (3)

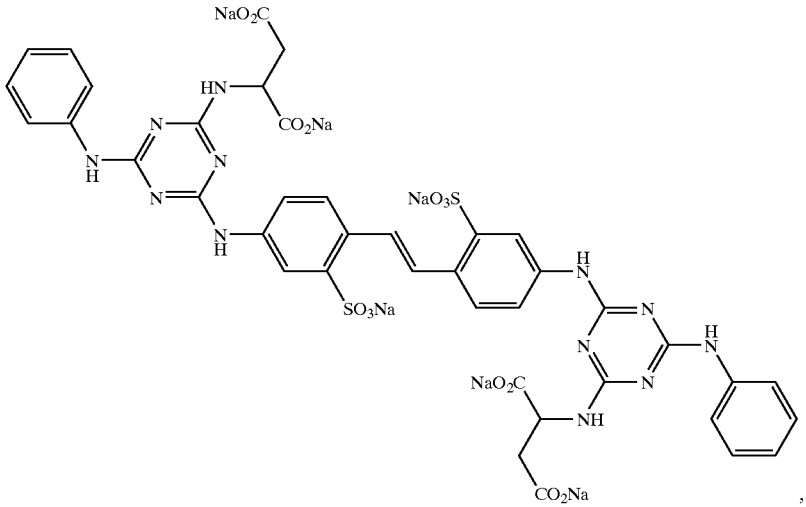

are mixed with 15 g of a 60% aqueous solution of a pentamethylol-melamine 2½-methyl ether (=LYOFIX CHN) in a glass container, further diluted to 120 g with deionised water and heated to 50° C. in a water bath, with stirring.

Precipitation is carried out at a pH of from 3.5 to 4.0 using 2N sulphuric acid. Heating is continued to from 85 to 90° C. and that temperature is maintained for 10 minutes. The pH is adjusted to from 10.0 to 11.0 over a period of 15 minutes using 30% aqueous sodium hydroxide solution. The mixture is then cooled, filtered using a suction filter apparatus equipped with a glass fibre filter and dried for 2 hours at 60° C. The gravimetrically determined yield is about 70% (+1.5).

Example 2

Preparation of the Formulation

The whitening pigment prepared in Example 1 is homogenised and microsolised in a glass bead mill by wet-grinding for two hours. The formulation has the following composition:

| Product | Amount in g | Amount in % |
|---|---|---|
| Whitening pigment | 4.5 | 15 |
| Polyviol V03/+40 (PVA) | 25.5 (of 5% solution) | 4.25 |
| Deionised water | (from Polyviol solution) | 80.75 |
| Total | 30.0 | 100.0 |
| Glass beads | 50.0 | |
| Total grinding material | 80.0 | |

Application Examples 3 parts of the formulation prepared in Example 2, calculated as dry substance, are added to a coating composition consisting of 60 parts of $CaCO_3$ and 40 parts of kaolin as coating pigment, and 1 part of polyvinyl alcohol as co-binder and 5 parts of a styrene-butadiene binder.

A wood-free paper is coated with 12 g/m$^2$ of the coating composition. The fluorescence (ISO) and whiteness (CIE), measured after drying, are 6.9 and 92, respectively, when the whitening agent of formula (2) is used and 9.0 and 100, respectively, when the whitening agent of formula (3) is used.

A coating without the addition of pigment has a fluorescence of 0 and a whiteness of 70.

What is claimed is:

1. A method of whitening paper, which comprises applying to paper a paper coating composition containing a whitening pigment comprising (a) a melamine-formaldehyde or phenol-formaldehyde polycondensation product and (b) a water-soluble fluorescent whitening agent of formula (1)

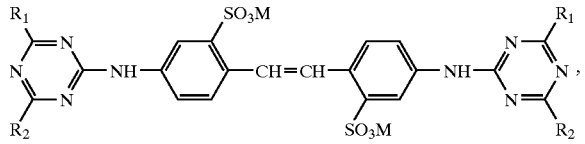

wherein $R_1$ and $R_2$ are each independently of the other —OH, —Cl, —$NH_2$, —O—$C_1$–$C_4$alkyl, —O—aryl, —NH—$C_1$–$C_4$alkyl, —N($C_1$–$C_4$alkyl)$_2$, —N($C_1$–$C_4$alkyl)($C_1$–$C_4$hydroxyalkyl), —N($C_1$–$C_4$hydroxyalkyl)$_2$ –NH—aryl, morpholino, S—$C_1$–$C_4$alkyl(aryl), or a radical of an amino acid, which radical is substituted at the amino group, and M is hydrogen; sodium; potassium; calcium; magnesium; ammonium; mono-, di-, tri- or tetra-$C_1$–$C_4$alkylammonium; mono-, di- or tri-$C_1$–$C_4$hydroxyalkylammonium; or ammonium di- or tri-substituted by a mixture of $C_1$–$C_4$alkyl and $C_1$–$C_4$hydroxyalkyl groups.

2. A method according to claim 1, wherein there is used as component (b) a fluorescent whitening agent of formula (1) wherein $R_1$ and $R_2$ as —NH-aryl are each independently of the other anilino, aniline-mono- or di-sulfonic acid or an anilinesulfonamide.

3. A method according to claim 1, wherein there is used as component (b) a fluorescent whitening agent of formula (1) wherein $R_1$ and $R_2$ as an amino acid are each independently of the other aspartic acid or iminoacetic acid, which each of which radicals is substituted at the amino group.

4. A method according to claim 1, wherein there is used as component (b) a fluorescent whitening agent of formula (1) wherein $R_1$ is anilino and $R_2$ and M are as defined in claim 1.

5. A method according to claim 4, wherein there is used as component (b) a fluorescent whitening agent of formula (1) wherein $R_2$ is NH—$C_1$–$C_4$alkyl, —N($C_1$–$C_4$alkyl)$_2$, —N($C_1$–$C_4$alkyl)($C_1$–$C_4$hydroxyalkyl), —N($C_1$–$_4$hydroxyalkyl)$_2$, morpholino, or a radical of aspartic acid or iminoacetic acid, which radical is substituted at the amino group, and M is hydrogen, sodium or potassium.

6. A method according to claim 1, wherein there is used as component (a) a melamine-formaldehyde polycondensation product.

7. A method according to claim 1, wherein the fluorescent whitening agent (b) is present in the whitening pigment in an amount of from 0.05 to 10% by weight.

8. A method according to claim 1, wherein the whitening pigment comprises, as component (c), up to 20% of a copolymer with an aromatic sulfonamide.

9. A method according to claim 1, wherein the whitening pigment comprises dry particles having a particle size of from 0.05 to 40 $\mu$m.

10. A method wherein a whitening pigment according to claim 1 is used for whitening a coating composition used in the textile, paint, adhesives, plastics, wood or paper industry.

* * * * *

UNITED STATES PATENT AND TRADEMARK OFFICE

CERTIFICATE OF CORRECTION

PATENT NO. : 6,797,752 B1
DATED : February 1, 2002
INVENTOR(S) : Peter Rohringer et al.

It is certified that error appears in the above-identified patent and that said Letters Patent is hereby corrected as shown below:

Title page,
Item [75], Inventors, should read:
-- [75] Inventors: Peter Rohringer, Schönenbuch (CH)
Marc Roger Grienenberger, Barthenheim (FR)
Stefan Ohren, Heusenstamm (DE)
Bernd Wockenfuss, Lörrach (DE) --

Signed and Sealed this

Twenty-second Day of February, 2005

JON W. DUDAS
*Director of the United States Patent and Trademark Office*